United States Patent [19]

Sakamoto et al.

[11] 4,367,032

[45] Jan. 4, 1983

[54] ELECTROSTATIC COPYING APPARATUS

[75] Inventors: Koji Sakamoto; Koji Hirakura; Yoshihiro Ogata; Harumi Takahashi, all of Tokyo, Japan

[73] Assignee: Ricoh Company, Ltd., Tokyo, Japan

[21] Appl. No.: 232,488

[22] Filed: Feb. 9, 1981

[30] Foreign Application Priority Data

Mar. 27, 1980 [JP] Japan ..... 55-39358
Apr. 24, 1980 [JP] Japan ..... 55-54696

[51] Int. Cl.[3] ..... G03G 15/18
[52] U.S. Cl. ..... 355/3 TR; 355/3 SH
[58] Field of Search ..... 355/3 TR, 3 SH, 14 TR, 355/14 SH; 430/33, 126

[56] References Cited

U.S. PATENT DOCUMENTS 4,159,172 6/1979 Tani et al. ..... 355/3 TR
4,171,157 10/1979 Suzuki ..... 355/3 TR
4,260,242 4/1981 Nishikawa ..... 355/3 SH X

FOREIGN PATENT DOCUMENTS 55-38543 3/1980 Japan ..... 355/3 TR

*Primary Examiner*—G. Z. Rubinson
*Assistant Examiner*—Keith E. George
*Attorney, Agent, or Firm*—David G. Alexander

[57] ABSTRACT

A toner image of an original document is formed on a photoconductive drum (1) and transferred onto a copy sheet (4) which is moved into contact with the drum (1) by a corona charging unit (5) which applies an electrostatic charge to the copy sheet (4) causing the toner image to be transferred thereto. The copy sheet (4) is separated from the drum (1) by a conductive belt (6). The belt (6) is initially grounded so that the leading edge of the copy sheet (4) is attracted thereto by induced electrostatic charge. A voltage of the same polarity as the transfer charge is then applied to the belt (6) to prevent transfer of the toner image back to the drum (1).

5 Claims, 7 Drawing Figures

ELECTROSTATIC COPYING APPARATUS

BACKGROUND OF THE INVENTION

The present invention relates to an electrostatic copying apparatus comprising improved means for separating a copy sheet from a photoconductive drum after toner image transfer.

A copy sheet may be separated from a drum by means of a conductive member as disclosed, for example, in U.S. Pat. No. 3,508,824. The conductive member is grounded and the copy sheet engages therewith after toner image transfer. The electrostatic charge of the copy sheet induces an opposite electrostatic charge on the conductive member which causes the copy sheet to be attracted to the conductive member and separated from the drum thereby.

A problem which is inherent in this arrangement is that the conductive member discharges the copy sheet and causes the toner image to be smeared or transferred back to the drum. For this reason, it has been practiced to connect a constant voltage element such as a Zener diode and a resistor between the conductive member and ground. In this case, although the leading edge of the copy sheet is separated from the drum due to the initially zero voltage on the conductive member, a voltage is developed across the constant voltage element due to induced charge from the copy sheet of the opposite polarity which causes the toner image to adhere to the copy sheet after separation from the drum.

This latter expedient does not completely overcome the problem, however, due to the delay in developing the voltage across the constant voltage element. This causes a leading edge portion of the toner image to be transferred back to the drum and lost. The problem is complicated further due to the fact that the rate of increase of voltage across the constant voltage element up to the constant voltage level depends on the pattern of the toner image, different sizes and thicknesses of copy sheets and other factors which vary to a large extent.

SUMMARY OF THE INVENTION

An electrostatic copying apparatus embodying the present invention includes a moving photoconductive member, imaging means for forming a toner image on the photoconductive member and transfer means for moving a copy sheet into contact with the photoconductive member and applying an electrostatic charge of a polarity to the copy sheet to transfer the toner image thereto, and is characterized by comprising a conductive member disposed so that the copy sheet engages therewith after the toner image is transferred to the copy sheet and the copy sheet is electrostatically separated from the photoconductive member by the conductive member, and power source means for applying a voltage of said polarity to the conductive member substantially as a leading edge of the copy sheet engages with the conductive member.

In accordance with the present invention, a toner image of an original document is formed on a photoconductive drum and transferred onto a copy sheet which is moved into contact with the drum by a corona charging unit which applies an electrostatic charge to the copy sheet causing the toner image to be transferred thereto. The copy sheet is separated from the drum by a conductive belt. The belt is initially grounded so that the leading edge of the copy sheet is attracted thereto by induced electrostatic charge. A voltage of the same polarity as the transfer charge is then applied to the belt to prevent transfer of the toner image back to the drum.

It is an object of the present invention to provide an improved electrostatic copying apparatus comprising improved means for effectively separating a copy sheet from a photoconductivedrum without loss of any part of a toner image.

It is another object of the present invention to provide a generally improved electrostatic copying apparatus.

Other objects, together with the foregoing, are attained in the embodiments described in the following description and illustrated in the accompanying drawing.

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
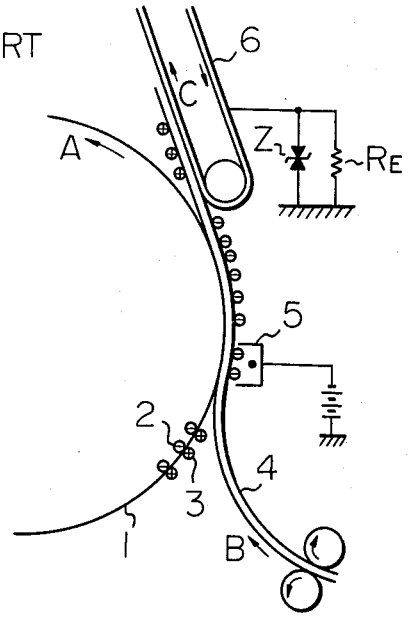
Fig. 1 PRIOR ART
FIG. 1 is a front view of an image transferring and sheet separating apparatus to which the present invention is applicable.

This type of system to which the present invention is applicable is illustrated in FIG. 1. The reference numeral 1 in FIG. 1 denotes a photosensitive element or photoconductive drum rotatable in the direction indicated by an arrow A. The photosensitive element 1 carries thereon a negatively charged electrostatic latent image 2 to which toner particles 3 with a positive polarity have been adhered. A transfer or copy sheet 4 advances toward the surface of the photosensitive element 1 as indicated by an arrow B and is applied with a negative charge by a corona charger 5 impressed with a DC voltage. Accordingly, the toner particles 3 are attracted and transferred onto the transfer sheet 4 to form a toner image thereon. The transfer sheet 4 now carrying the toner image moves to a location where a conductive belt 6 of 40 $\mu$m thick nickel or the like is positioned while being adhered to the surface of the rotating photosensitive element 1. The conductive belt 6 is rotated as indicated by an arrow C and is grounded through a constant voltage or Zener element Z and a resistor $R_E$. The negative charge on the transfer sheet 4 thus develops a positive charge in the conductive belt 6 by electrostatic induction so that an electrostatic attractive force acting between the two opposite charges allows the transfer sheet 4 to be attracted to the belt 6 and separated or stripped thereby from the photosensitive element 1. The potential of the belt 6 is initially zero but, as the transfer sheet 4 moves closer thereto, it progressively increases until it stabilizes at a level determined by the constant voltage element Z (usually on the order of −600 V).

The potential of the conductive belt 6 has a significant influence on the image transferring and sheet stripping abilities of a copying machine. Although a zero potential on the conductive belt 6 may offer sufficient stripping ability, it at the same time makes the attractive force on the toner 3 toward the transfer sheet 4 deficient and permits unwanted re-transfer of the toner 3 onto the photosensitive element 1 which is detrimental to the image transferring ability. These conflicting problems may appear as being settled by the variation in the potential of the conductive belt 6 with time. Before the arrival of the transfer sheet 4, the conductive belt 6 has its potential kept at the zero level in order to offer a sufficient sheet stripping ability. This promotes separation of the sheet 4 at a leading edge portion of the moving transfer sheet 4 at the sacrifice of the image transferring ability. As the transfer sheet 4 contacts the belt 6 through a progressively increasing area, the potential of the belt 6 increases until it reaches the level determined by the constant voltage element Z. Such an increase in the belt potential recovers the transferring ability. Although the intensity of the force allowing the transfer sheet 4 to adhere to the belt 6 progressively decreases in accordance with the increase in the belt potential, the adhered condition of the transfer sheet 4 can still be maintained despite the decrease in the adhering force after the leading edge portion of the sheet 4 has been adhered to the belt 6. The transfer sheet 4 can thus be stripped continuously from the photosensitive element 1.

While the process discussed above may appear as satisfying both of the image transferring and sheet separating functions, the result obtainable therewith is not always as expected. A satisfactory transferring or separating function may be unattainable depending on the material and size of the transfer sheet 4 as well as ambient conditions.

Figure 2:
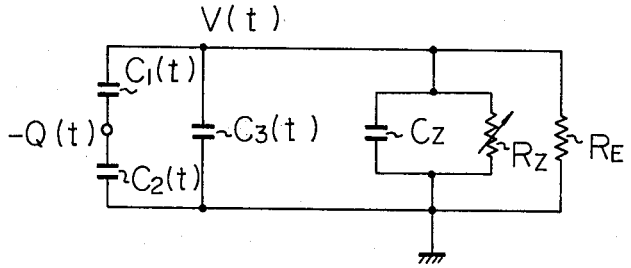
Fig. 2 PRIOR ART
FIG. 2 is an equivalent circuit of the apparatus shown in FIG. 1.

FIG. 2 shows an equivalent circuit of the image transferring and sheet separating system described in connection with FIG. 1. The equivalent circuit has therein an electrostatic capacitance $C_1(t)$ between the transfer sheet 4 and conductive belt 6, an electrostatic capacitance $C_2(t)$ between the transfer sheet 4 and photosensitive element 1, an electrostatic capacitance $C_3(t)$ between the conductive belt 6 and photosensitive element 1 (an area therebetween where the transfer sheet 4 is absent), an electrostatic capacitance $C_Z$ of the constant voltage element Z, and a resistance $R_Z$ of the constant voltage element Z. The capacitances $C_2(t)$ and $C_3(t)$ include the electrostatic capacitance of the photosensitive elememt 1. It will be noted that, concerning the capacitances $C_1(t)$ and $C_2(t)$ mentioned, the "transfer sheet 4" implies the position of the charge in the transfer sheet 4 in a literal sense. Also indicated in the diagram of FIG. 2 is a potential V(t) of the transfer sheet 4. The transfer sheet 4 carries a charge denoted by −Q(t). It should be born in mind that the suffix (t) indicates that the corresponding parameter is a function of time. As seen from the equivalent circuit, the potential V(t) of the conductive belt 6 is produced by charging of an RC time constant circuit and, since the capacitances $C_1$, $C_2$ and $C_3$ fluctuate for the aforementioned reasons, the rising characteristic of the potential V(t) also fluctuates. This is considered to constitute a cause of the influence on the image transferring and sheet separating abilities. Furthermore, because the variation in the charge −Q(t) on the transfer sheet 4 with respect to time is of such a small value, the potential V(t) takes a prolonged period of time to increase resulting in insufficient image transfer during said period of time.

Figure 3:
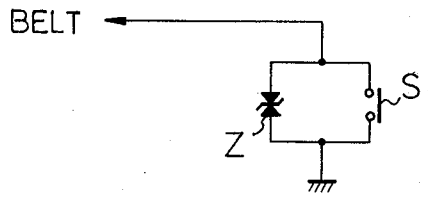
Fig. 3 PRIOR ART
FIG. 3 illustrates a different circuit provided with prior art improvement.

An alternative design heretofore proposed to overcome the above-described problems employs a relay contact or switch S as viewed in FIG. 3 in place of the resistor $R_E$ connected in parallel with the constant voltage element Z in FIG. 2. When the transfer sheet 4 approaches the conductive belt 6, the relay contact S is closed to make the potential V(t) zero thereby increasing the sheet separating ability. After the start of sheet separation, the relay contact S is opened. In this case, the potential V(t) increases relatively rapidly because the bypass circuit formed by the resistor $R_E$ is absent.

Figure 4:
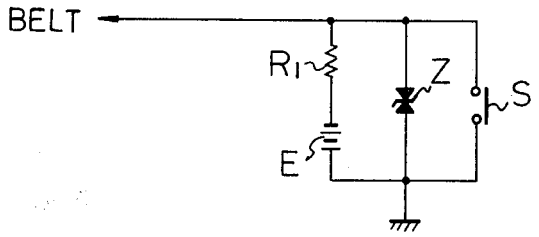
FIG. 4 is a circuit diagram of an embodiment of the present invention.

However, the increase in the potential V(t) relies on the charge −Q(t) on the transfer sheet 4 which is very small and, hence, the increase time of the potential V(t) can only be shortened to a limited extent. Another and further improved circuit design is shown in FIG. 4. This circuit of FIG. 4 includes a series connection of an external power source E and a protective resistor $R_1$, which is connected in parallel with the constant voltage element Z. The external power source E in cooperation with the charge −Q(t) of the transfer sheet 4 increases the potential V(t) of the conductive belt 6 faster, permitting the increase time of the potential V(t) to be shortened.

The arrangement of FIG. 4 does not rely on the charge −Q(t) of the transfer sheet 4 in increasing the potential V(t) and, therefore, it is freed from the influence of the material, size and ambient conditions of the transfer sheet 4.

Figure 5:
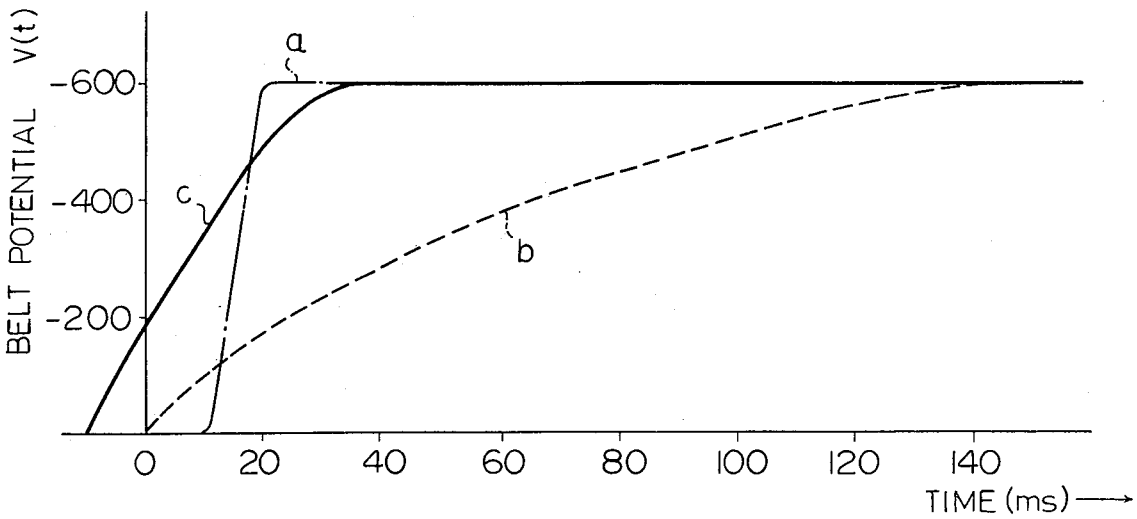
FIG. 5 graphically shows various variations in the potential of a conductive belt.

With this type of arrangement, the potential V(t) of the conductive belt 6 will undergo variation as graphically shown in FIG. 5 by a curve a. A curve b in FIG. 5 indicates a variation of the same potential V(t) obtainable with the non-improved version illustrated in FIG. 1. Comparing the curves a and b, it will be apparent that the design shown in FIG. 4 shortens the increase time of the potential V(t). This design still involves a drawback, however, in that the potential V(t) increases so sharply that the transfer sheet 4 cannot avoid an area at its leading edge portion where the transfer of the image has been prevented and which is sharply and noticeably defined relative to the rest of the transfer sheet 4.

The time the contact S is opened may be determined by a sensor or the like which determines the position at the sheet 4. The sensor may be located in the sheet feed path or may sense another event such as driving of an optical scanning system, sheet feed registration drive, or the like. The time axis in FIG. 5 indicates the time before and after the leading edge of the sheet 4 engages the belt 6.

Figure 6:
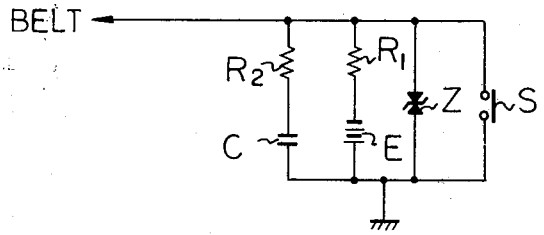
FIG. 6 is a circuit diagram showing another embodiment of the present invention.

Referring to FIG. 6, there is shown an image transferring and sheet separating apparatus according to the present invention. As shown, the system includes a capacitor C and a protective resistor $R_2$ which constitute an RC time constant or delay circuit and are connected in series with each other. This series connection is connected in parallel with the circuit described with reference to FIG. 4. The capacitor C may have a capacitance of 0.0235 μF and the resistor $R_2$ a resistance of 50 KΩ by way of example. Since this capacitance is larger by more than one order of magnitude than those of the capacitances $C_1(t)$, $C_2(t)$ and $C_3(t)$ of the equivalent circuit shown in FIG. 2, the voltage increase charateristic of the potential V(t) can be determined freely without being influenced by other fluctuations. Accordingly, suitable selection of the time constant or potential increase characteristic or rate and the timing for opening the relay contact S will enable the omission of image transfer at the leading edge portion of the copy sheet 4 to become unnoticeable and the transfer sheet 4 to be stripped positively from the photosensitive element 1. A curve c in FIG. 5 indicates a potential increase characteristic afforded by the present invention and which is not so sharp as the characteristic curve a. According to the system of the invention, the relay contact S is opened at a time earlier than a time 0 at which the transfer sheet 4 engages the conductive belt 6, so that the potential V(t) of the belt 6 will have reached approximately 200 V when the sheet 4 initially contacts the belt 6.

In summary, an electrostatic copying apparatus according to the present invention employs a conductive conveying member which is grounded through a circuit including a capacitor and is connected to an external DC power source, and the system controls a start of voltage application from the DC power source to the conveying member in conformity with the feed timing of a transfer sheet. It will thus be appreciated that the system of the invention allows the conveying member to efficiently and positively separate a transfer sheet by maintaining a potential on the conveying member low. The rate of the subsequent increase in the potential can be freely selected through the external power source and a capacitor connected with the conveying member. This promotes smooth recovery of the image transferring ability which in turn makes the omission of image transfer substantially unnoticeable. Additionally, the image transferring and sheet separating abilities remain always stable because the potential of the conveying member is principally determined by the external DC power source and capacitor without relying on floating capacitances which involve fluctuant factors ($C_1$, $C_2$ and $C_3$).

Figure 7:
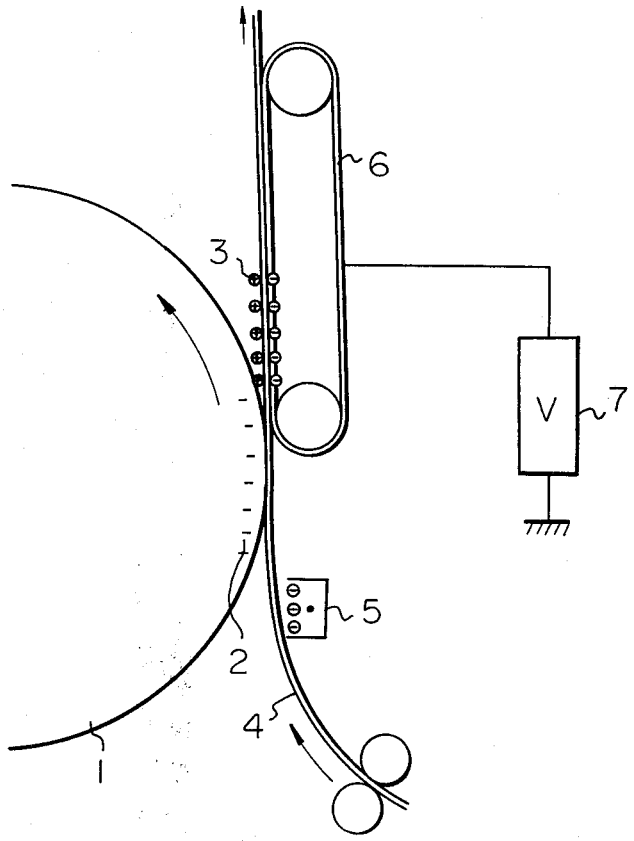
FIG. 7 is a front view of another apparatus embodying the present invention.

Various modifications will become possible for those skilled in the art after receiving the teachings of the present disclosure without departing from the scope thereof. For example, in FIG. 7 a power source 7 initially grounds the belt 6 but applies a voltage of the same polarity as the transfer charge to the belt 6 as the leading edge of the copy sheet 4 engages therewith. Although this arrangement may cause slight loss of the toner image at the very leading edge portion of the copy sheet 4, the amount of loss is very small and may be considered neglible in certain applications.

What is claimed is:

1. An electrostatic copying apparatus including a moving photoconductive member, imaging means for forming a toner image on the photoconductive member and transfer means for moving a copy sheet into contact with the photoconductive member and applying an electrostatic charge of a polarity to the copy sheet to transfer the toner image thereto, characterized by comprising:

a conductive member disposed so that the copy sheet engages therewith after the toner image is transferred to the copy sheet and the copy sheet is electrostatically separated from the photoconductive member by the conductive member; and power source means for applying a voltage of said polarity to the conductive member substantially as a leading edge of the copy sheet engages with the conductive member;

the power source means comprising a power source for providing said voltage, switch means for connecting the conductive member to the power source or ground and time constant means for controlling a rate of increase of said voltage applied to the conductive member;

the conductive member comprising an endless belt.

2. An apparatus as in claim 1, in which the switch means is constructed to connect the conductive member to ground slightly before the leading edge of the copy sheet engages with the conductive member.

3. An apparatus as in claim 1, in which the switch means is constructed to initially short out the time constant means and to unshort the time constant means while connecting the conductive member to the power source.

4. An apparatus as in claim 1, in which the power source means further comprises a constant voltage element.

5. An apparatus as in claim 1, in which the time constant means comprises a resistor and a capacitor having a capacitance which is larger by more than one order of magnitude than those of a capacitance between the copy sheet and the conductive member, a capacitance between the copy sheet and the photoconductive member and a capacitance between the conductive member and the photoconductive member.

* * * * *